United States Patent [19]

Castelli et al.

[11] 4,091,791

[45] May 30, 1978

[54] BALL THROWING MACHINE

[75] Inventors: Joseph Tom Castelli; Joseph J. Forrester, both of Pittsburgh, Pa.

[73] Assignee: Instrument Services, Inc., Bridgeville, Pa.

[21] Appl. No.: 614,880

[22] Filed: Sep. 19, 1975

[51] Int. Cl.[2] ..... F41B 11/02

[52] U.S. Cl. ..... 124/73; 124/81; 124/41 C; 124/50; 124/82

[58] Field of Search ..... 124/41 R, 50, 51 A, 124/64, 65, 70, 72, 73, 75, 81, 82, 83, 41 C, 77; 273/26 D, 29 A

[56] References Cited

U.S. PATENT DOCUMENTS

| | | | |
|---|---|---|---|
| 2,182,369 | 12/1939 | Barron | 124/81 |
| 2,729,207 | 1/1956 | Foster | 124/51 A |
| 2,801,624 | 8/1957 | Feltman | 124/72 |
| 3,018,769 | 1/1962 | Parsoneault | 124/75 |
| 3,724,437 | 4/1973 | Halstead | 273/26 D |
| 3,838,676 | 10/1974 | Kahelin | 124/75 |
| 3,917,265 | 11/1975 | Schrier et al. | 124/81 |

*Primary Examiner*—Richard C. Pinkham
*Assistant Examiner*—Vance Y. Hum
*Attorney, Agent, or Firm*—Robert D. Yeager; Howard G. Massung

[57] ABSTRACT

A ball throwing machine having a flat, circular resilient disc with an off-center opening formed therein through which a ball to be thrown is forced at a predetermined velocity. By properly positioning the flat circular resilient disc, having the off-center opening formed therein, a thrown ball can be made to spin about any axis perpendicular to the ball trajectory. A tubular barrel is mounted adjacent to the resilient disc so that as a ball is forced from the throwing machine it is forced through the opening in the resilient disc and into and out of the barrel. The barrel, which is positionable, permits the ball ejected from the throwing machine to be accurately aimed in any desired direction. A firing chamber is located adjacent the resilient disc on the side opposite the barrel. Balls to be thrown are fed into the firing chamber by a ball feeder. When a ball to be fired is positioned in the firing chamber, the firing chamber to the rear of the ball is sealed and a compressed air charge of a predetermined pressure is introduced into the rear of the firing chamber rapidly forcing the ball through the opening in the resilient disc and out of the barrel. The pressure built up in the firing chamber before the ball is expelled through the resilient disc and the barrel determines the velocity of the thrown ball. Thus it can be seen that any type of curved ball, at any desired velocity, can be thrown from the disclosed ball throwing machine. An air reservoir chamber axially aligned with the firing chamber and the tubular barrel is disposed behind the firing chamber. A firing valve, having an open position allowing free communication between the air reservoir and the firing chamber and a closed position eliminating any communication therebetween, is disposed between the air reservoir and the firing chamber.

30 Claims, 8 Drawing Figures

BALL THROWING MACHINE

BACKGROUND OF THE INVENTION

1. Field of the Invention

This invention relates to a ball throwing machine and more particularly to a ball throwing machine which forces the ball to be thrown through an off-center opening in a resilient disc.

2. Description of the Prior Art

Automatic pitching or ball throwing machines are utilized by many sporting organizations to provide practice and improve the skills of the players. To be effective the ball throwing machine must accurately simulate movement of a ball under actual playing conditions. For example, a right hand pitcher throws a ball which can curve to his left, while a left hand pitcher throws a ball which can curve to his right. Pitchers can also vary their velocity and provide other spins to cause the ball to move as desired. Likewise, balls which are hit, either on the ground or in the air, have various movement characteristics which the machine should accurately reproduce. An effective ball throwing machine must accurately and repeatably propel the ball with the desired movement.

Pneumatically operated ball throwing machines are old and well known in the prior art. For example, U.S. Pat. No. 1,379,403, issued May 27, 1921, discloses a pneumatic ball projector which utilizes compressed air for throwing the ball and also for causing the ball to follow a curved course the direction of which may be controlled by the operator of the machine. Grooves formed in the barrel of the machine determine the direction of curve of the thrown ball.

Other patents to pneumatic ball throwing machines such as U.S. Pat. No. 2,526,018, U.S. Pat. No. 3,584,614 and U.S. Pat. No. 2,935,980 disclose ball projecting machines which utilize friction strips or rails within a barrel to cause unequal drag on the thrown ball causing the ball to spin in a selected direction when ejected. As the ball is pneumatically forced down the barrel, movement of a portion of the ball is impeded so that the ball is spinning in a desired manner when it is projected from the machine.

While in other machines such as those shown in U.S. Pat. Nos. 3,467,073 and 3,662,729 pneumatically driven ball throwing machines have mechanical attachments for mechanically rotating the ball before it is pneumatically ejected from the throwing machine. For example, in U.S. Pat. No. 3,662,729 when a curve is desired, a motor is energized to spin the ball at a desired speed so that the thrown ball has this spin speed when ejected. In U.S. Pat. No. 3,467,073 rollers which can be rotated in an opposite direction spin the ball before the ball is launched from the pneumatic throwing machine.

Various toys have been disclosed for projecting light weight spheres usually in the form of a plastic table tennis ball. Typical of these toy type ball throwing devices are U.S. Pat. Nos. 2,505,428 and 2,975,779. A toy gun which projects ping-pong ball held by a resilient disc having a hole therein is disclosed in U.S. Pat. No. 2,505,428 issued Apr. 25, 1951. The toy gun disclosed in this patent is not concerned with throwing a curve ball. Also the toy gun could not project a relatively heavier ball with any substantial velocity. U.S. Pat. No. 2,975,779 issued Mar. 21, 1961, disclosed a toy curve ball projecting device utilizing a resilient ring with a centered hole formed therein through which the ball to be thrown is forced. The centered hole is adapted to cause different frictional engagement on various portions of the ball to be thrown; then a ball is forced through the resilient ring, it spins towards the created high friction side of the centered opening. The device disclosed in this patent is utilized for projecting light weight table tennis balls. There is no readily available means for preselecting the velocity of the balls to be projected. Also, no reservoir of compressed air is provided and the device is not operable for throwing heavier balls, such as tennis or baseballs, at high speeds for a relatively long distance.

It is desirable to have a ball throwing device which can be easily aimed and is adjustable for speed and direction of curve. It is also advantageous for the throwing machine to be relatively light weight and portable for use in various areas. The machine should also be easily adjustable to allow for different uses.

SUMMARY OF THE PRESENT INVENTION

In accordance with the teaching of the present invention, a ball throwing machine is provided which projects a ball at a selected velocity through a resilient disc having an off-center opening formed therein. A tubular barrel is disposed in proximity to the disc so as the ball is forced through the off-center opening, it is forced into the tubular barrel. The resilient disc having the off-center opening formed therein is rotatable and controls the direction of curve of a ball projected from the disclosed throwing machine. The barrel provides for accurate aiming of a ball forced from the ball throwing machine. Operation and control of the machine is provided by a compressed gas, normally air. When a ball is thrown from the disclosed machine, the resilient disc is forced out and into engagement with the inner diameter of the tubular barrel.

An elongated firing chamber is provided adjacent the resilient disc on the side opposite the tubular barrel. A feed mechanism is provided for feeding balls to be ejected, one at a time, into the firing chamber. When a ball in the firing chamber is to be ejected, it is moved into engagement with the resilient disc having the off-center opening formed therein, and the firing chamber to the rear of the ball is sealed. A compressed air charge is then introduced into the sealed portion of the firing chamber rapidly ejecting the ball with the desired velocity. An air reservoir is located behind the firing chamber. The tubular barrel, the firing chamber, and the air reservoir are disposed along a common longitudinal axis which can be adjusted as desired to control the direction of the ball ejected from the disclosed ball throwing machine. The velocity of the ball ejected from the disclosed ball throwing machine can be predetermined from the working air reservoir.

A firing valve, which controls communication between the air reservoir and the firing chamber is disposed in the working air circuit between the air reservoir and the firing chamber. When the firing valve is in the open position, the compressed gas stored in the reservoir is free to pass into the firing chamber forcing the contained ball out. A spring biased piston controlled by the pressure in the air reservoir is disposed between the air reservoir and the firing circuit. The piston is operable between an open position, allowing a ball to be fed into the firing chamber, and a sealing position, forcing a ball in the firing chamber into engagement with the resilient disc and closing off other openings into the firing chamber thereby sealing the firing chamber. The piston controls a movable sleeve which moves along the outside of the firing chamber to seal the firing chamber when the piston is in the sealing position. A set of O-rings sealably engage the sleeve when in the sealing position. The piston is movable between an open position and a sealing position, wherein the ball to be thrown is forced into engagement with the resilient disc and the firing chamber is sealed. The piston is spring biased to the open position and only moves to the sealing position when the air pressure differential between the air reservoir and the firing chamber exceeds a predetermined level. When the air pressure differential between the air reservoir and the firing chamber is insufficient to overcome the spring biasing force, the piston is moved by the biasing spring to the open, retracted position. When the piston is in a sealing position and the firing valve is activated, the air charge from the air reservoir passes into the firing chamber rapidly expelling the ball contained therein from the ball throwing machine. A plurality of openings are formed around the circumference of the sleeve, in proximity to one end, to relieve pressure in the firing chamber, from a trapped charge, when the sleeve is moved to the open position. This prevents blow out of the sealing O-ring.

The volume of the air reservoir and the pressure of the gas contained therein determines the velocity of the ball ejected from the firing chamber. By varying the pressure of the gas in the air reservoir, it is possible to vary the speed of the balls ejected from the disclosed throwing machine. A pressure gauge calibrated in ball velocity can be attached to the air reservoir for indicating ball speed when it is ejected from the firing chamber. A relief valve is attached to the air reservoir for venting to atmosphere when desired.

When it is desired to throw a ball, a compressed air charge of a selected pressure is built up in the air reservoir and then the firing valve is opened introducing the compressed air charge into the rear of the firing chamber. A speed regulator is provided on the pneumatic line feeding the air reservoir for controlling the pressure of the working gas stored therein. The speed indicator, which is a pressure gauge calibrated in ball velocity, is connected in the pressure line communicating with the air reservoir. An air compressor is provided for supplying the control air and the working air to the disclosed ball throwing machine. The air compressor can be electrically driven, gas driven, or more than one air compressor driven by various energy sources can be provided if desired. A check valve is provided in the output line of each air compressor. If, as is desirable, the machine is provided for either electric or gasoline operation, when an electric supply is available, the electrically driven compressor will normally be utilized. In situations where electric power is not readily available, the gasoline driven compressor can be utilized. The ball throwing machine is mounted on a wheeled portable assembly for easy movement to any desired location. The air reservoir, the firing chamber and the barrel are longitudinally aligned along a common axis which can be positioned to throw the balls in any desired direction. That is, the ball throwing machine not only can throw pitches as desired, but also can be used to throw fly balls and ground balls for practice.

A selector having an automatic position and a manual position is provided on the firing valve. A manual firing valve is disposed between the interval selector firing valve and the air reservoir and controls operation of the firing valve when the selector is in the manual position. Interval timed operation is provided when the selector is in the automatic position. The firing valve controls operation of the ball throwing machine automatically when the selector is in the automatic position. The interval timer has an adjustable timing interval at which it operates the firing valve. A relief valve is provided between the air supply and the supply side of the speed regulator. When pressure on the supply side of the speed regulator exceeds a selected value, the relief valve operates to prevent equipment damage. When the relief valve operates, excess air from the supply is vented to atmosphere.

A right hand ball pitcher curves a ball to his left, while a left hand pitcher curves a ball to his right. Pitchers provide various other spins on the ball to cause it to curve as desired. The resilient disc having the off-center opening as disclosed in this invention is adjustable to permit the ball to be given a spin around any axis perpendicular to the ball trajectory. The ejected ball tends to curve in the direction of the center of the opening in the resilient disc. That is, the spin imparted to the thrown ball will cause the ball to move in a curve from the longitudinal axis defined by the firing chamber and barrel. The ball will curve in the direction which the off center opening in the resilient disc is displaced from the longitudinal axis. When no spin is desired, a disc having a centered opening can be utilized.

The aligned barrel, firing chamber, and air reservoir are completely adjustable to allow the ball to be thrown at any selected target area. Operation of the disclosed ball throwing device is consistently repeatable and can be varied as desired to provide for different operating conditions. The disclosed machine can be used in baseball for pitching practice, for throwing various types of ground balls for fielding practice, or for throwing fly balls having different spins for outfield practice. The disclosed machine is also useful for throwing tennis balls which can simulate any type of serve or return.

Although reference is made herein to throwing balls of various types, it is to be understood that the disclosed throwing machine can be used to launch other objects such as grenades, flares, clay pigeons, and the like, and the term ball as used in the specification and claims is exemplary of all such objects which can be launched by the disclosed throwing machine. Where the term air is used herein, it is to be understood that the use of other gases is possible and the term air is representative of all such usable gases.

It is an object of this invention to teach a simple, rugged ball throwing machine which utilizes a compressed air supply for ejecting a relatively heavy ball through an opening formed in a resilient disc.

It is a further object of this invention to teach a pneumatic ball throwing machine which forces the ball to be thrown through an off-center opening in a resilient disc causing the ball to curve as desired.

BRIEF DESCRIPTION OF THE DRAWINGS

For a better understanding of the invention, reference may be had to the preferred embodiment exemplary of the invention shown in the accompanying drawings, in which.

DESCRIPTION OF THE PREFERRED EMBODIMENT

Figure 1:
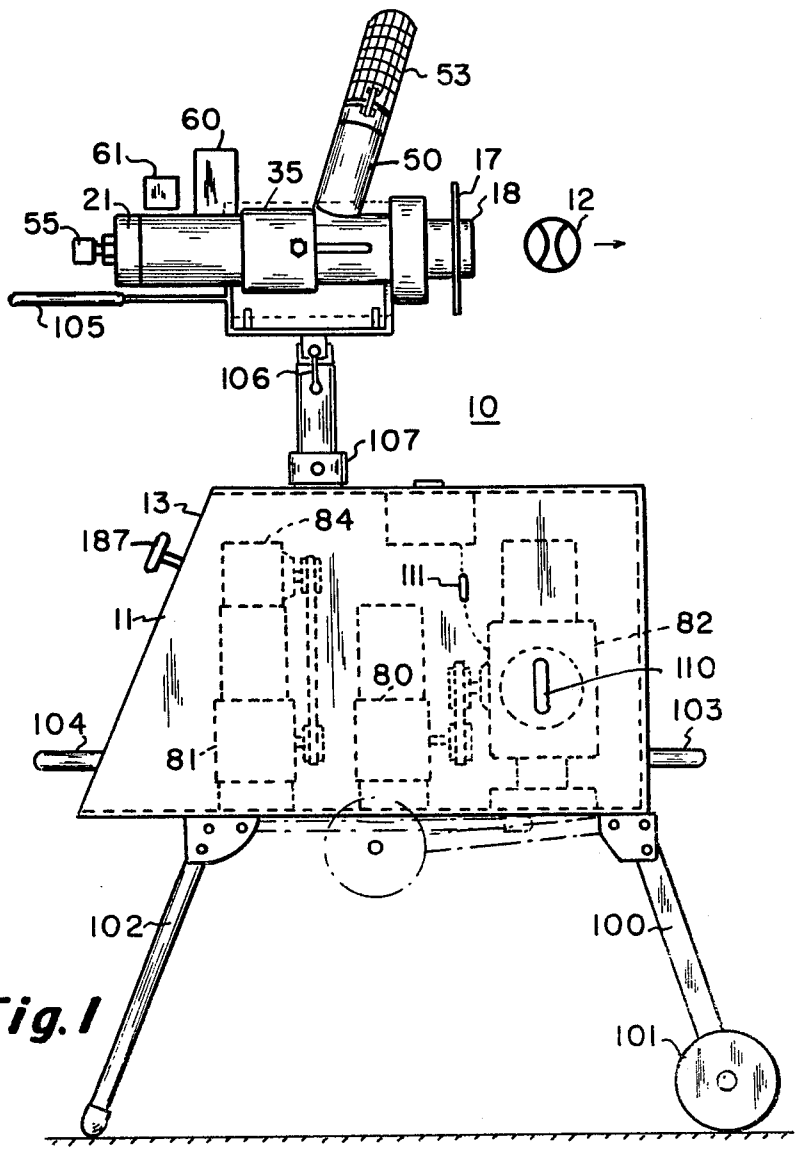
FIG. 1 is a side view of a ball throwing machine constructed in accordance with the teaching of the present invention.

Referring now to the drawings, and FIGS. 1 through 7 in particular, there is shown a ball throwing machine 10 utilizing the teaching of the present invention. Ball throwing machine 10 ejects a ball 12 from the machine with a predetermined velocity and spin. As can best be seen in FIGS. 3 and 6, a member or disc 14 formed of a resilient material and having an off-center opening 16 formed therein is disposed in the ball throwing machine 10. When a ball is to be thrown, it is rapidly forced through the opening 16 of resilient member 14 out of the ball throwing machine 10. A tubular barrel 18 is disposed on the outlet side of resilient disc 14. When a ball is forced from throwing machine 10, resilient disc 14 is forced into engagement with the inner diameter of barrel 18 as shown by phantom lines 19 in FIG. 6. As the disc 14 is forced into engagement with the inner diameter of barrel 18 it is compressed by ball 12 and this effects the required firing pressure.

A firing chamber 20 is disposed behind resilient disc 14. An air reservoir 40 is disposed to the rear of firing chamber 20. Firing chamber 20 and air reservoir 40 can be formed in a common tubular member 21. When a ball is to be fired from firing chamber 20, the ball 12 is moved into engagement with the resilient member 14 and the rear of the firing chamber 20 is sealed. A charge of compressed air is then introduced into the rear of firing chamber 20 rapidly expelling ball 12 from firing chamber 20 through the off-center opening 16 in resilient disc 14.

Figure 6:
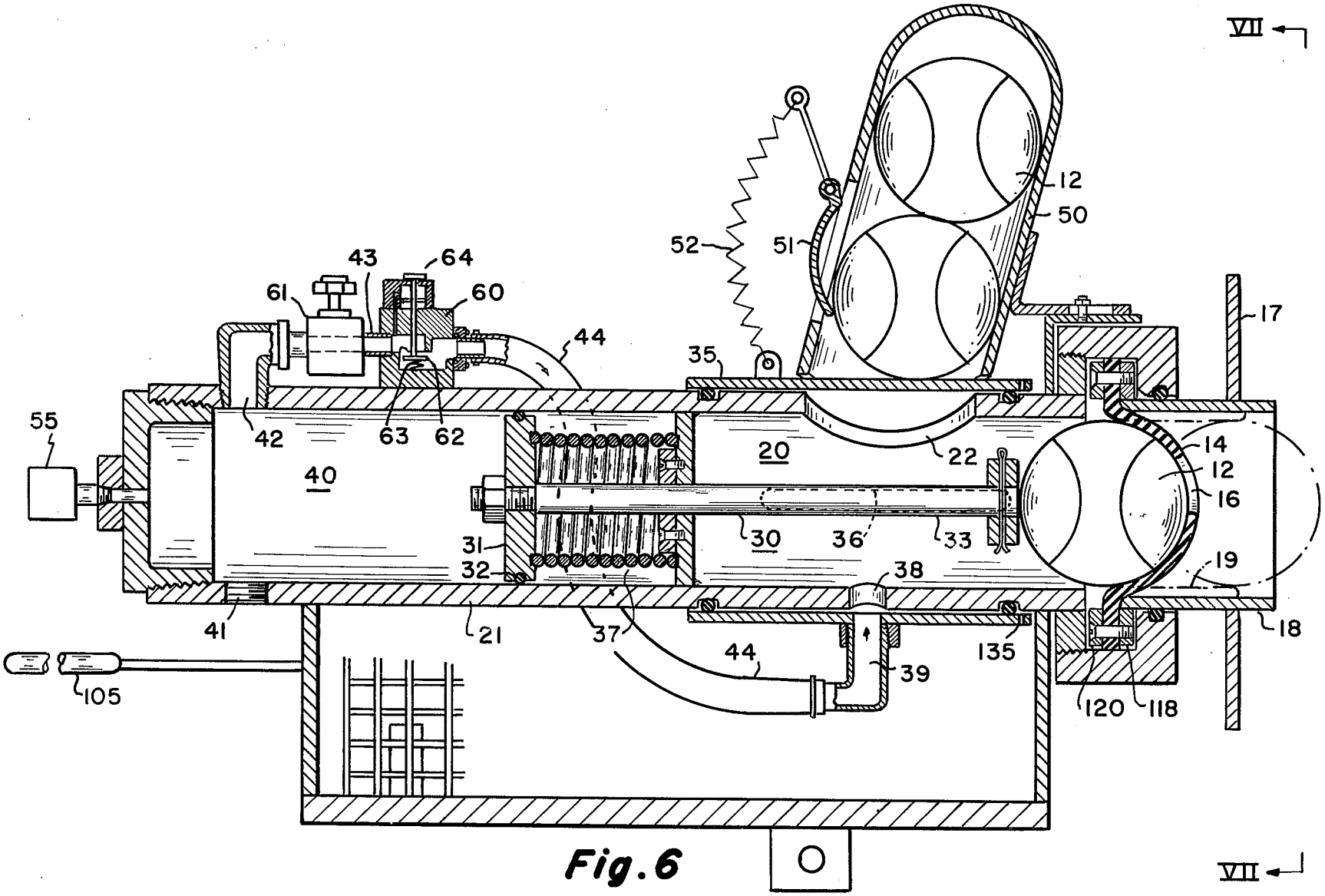
FIG. 6 is a sectional view similar to FIG. 3, but showing the piston in the sealing position and the firing valve in the open position.

A piston assembly 30 is disposed in tubular member 21 between air reservoir 40 and firing chamber 20. Piston assembly 30 is movable between a sealing position shown in FIG. 6, wherein firing chamber 20 is sealed and an open position, shown in FIG. 3, wherein firing chamber 20 is not sealed. A piston head 31 provided with an O-ring 32 provides an air tight seal between firing chamber 20 and air reservoir 40. Piston 31 has piston rod 33, rigidly attached thereto. Piston rod 33 is connected by bolts 34 to slidable sleeve 35. Slots 36 are provided in tubular member 21 for connecting slidable sleeve 35 to piston rod 33. When piston rod 33 moves to the sealing position as shown in FIG. 6, the end of piston rod 33 forces a ball 12 contained in firing chamber 20 into engagement with resilient member 14. As piston rod 33 forces ball 12 into engagement with resilient disc member 14 slidable sleeve 35 moves into sealing position, sealing the rear of the firing chamber 20. Firing chamber 20 has an opening 22 formed therein through which balls from feeder 50 can be fed. Firing chamber 20 is also provided with an air inlet 38. Slidable member 35 is provided with an air supply opening 39 which is aligned with air inlet 38 when piston 31 is in the sealing position. When orifices 38 and 39 are aligned, compressed air can be introduced into the firing chamber 20 through flexible line 44. Openings 38 and 39 can only be aligned when piston assembly 30 is in the sealing position. This assures that a compressed air charge cannot be introduced into firing chamber 20 until firing chamber 20 is sealed. That is compressed air cannot be introduced into firing chamber 20 until firing chamber 20 is sealed by slidable sleeve 35.

A compression spring 37 is provided for spring biasing piston 31 towards the open position. As the air pressure in air reservoir 40 increases and the pressure differential between air reservoir 40 and firing chamber 20 increases, piston assembly 30 is forced to the sealing position shown in FIG. 6. When the ball throwing machine is fired and the pressures in air reservoir 40 and firing chamber 20 equalize, piston 31 is moved to the open position shown in FIG. 3 under the influence of compression spring 37. Thus after a ball is ejected from firing chamber 20, firing chamber 20 is again opened, automatically admitting a ball from feed assembly 50.

A relief valve 55 is provided on air reservoir 40 for relieving pressure in air reservoir 40 without firing ball thrower 10. This relief valve 55 can be manually operated if desired. Relief valve 55 can be operated for initial start up, to cause a ball 12 to be fed into firing chamber 20, or at shut down, to relieve pressure.

Figure 3:
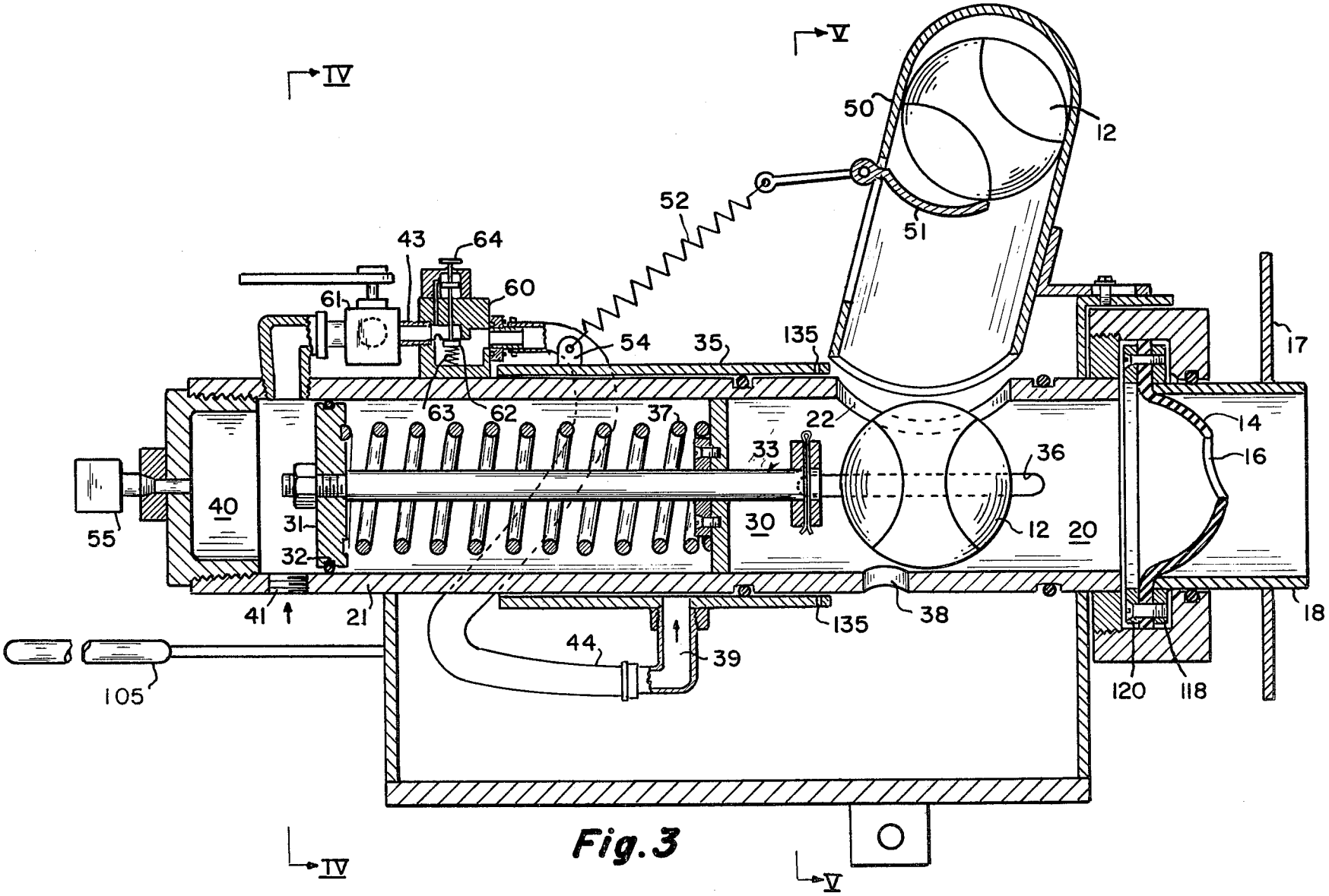
FIG. 3 is a side sectional view of a portion of the ball throwing machine shown in FIG. 1.

An air inlet 41 is provided in air reservoir 40 for feeding compressed air into air reservoir 40. An outlet 42 from air reservoir 40 is provided which is connected to a firing valve 60 through air conductor 43 and a manual control valve 61. Firing valve 60 is operable between a closed position, as shown in FIG. 3, preventing air flow therethrough, and an open position, shown in FIG. 6, allowing free communication between the firing chamber 20 and air reservoir 40. Firing valve 60 has a movable seat 62 disposed therein. Movable seat 62 is spring biased to a closed position by compression spring 63. Firing valve 60 is a conventional time delay air valve such as a Timac, manufactured by Mac Valves, Inc. Firing valve 60 is provided with an interval control 64. When compressed air is provided in line 43 by opening manual valve 61, seat 62 is moved to the open position at selected intervals. As seat 62 moves to the open position, the compressed air in reservoir 40 flows into firing chamber 20. When firing chamber 20 and air reservoir 40 are in free communication, ball 12 is rapidly expelled from throwing machine 10. With ball 12 expelled, firing chamber 20 is in free communication with atmosphere through opening 16 and the pressure in firing chamber 20 and air reservoir 40 falls toward atmospheric pressure. As the pressure differential across firing chamber 20 and air reservoir 40 is removed, piston assembly 30 moves to the open position with sleeve 35 retracted admitting another ball to firing chamber 20. With the control signal removed and chamber 40 approaching atmospheric pressure, seat 62 is moved to the closed position shown in FIG. 3 under the influence of spring 63.

Feed assembly 50 is provided for feeding balls 12 one at a time into firing chamber 20. A pivotal member 51 assures only one ball 12 at a time is present in firing chamber 20. When piston 31 is in the open position, pivotal member 51 is spring biased to an up position, as shown in FIG. 3, by spring 52. Spring 52 has one end connected to sleeve 35 and when sleeve 35 moves to the sealing position the spring bias is removed from pivotal member 51. Pivotal member 51 then moves downward under the weight of balls 12. In the down position member 51 does not protrude into feed tube 53 thus allowing a ball 12 to rest on sleeve 35. When slidable sleeve 35 moves to the open position unsealing firing chamber 20, a first ball 12, resting on sleeve 35, drops into firing chamber 20. A slide 35 opens, member 51 pivots upward. With member 51 in the up position, it engages the next ball 12 preventing more than one ball 12 from entering chamber 20. When ball thrower 10 is fired and slide 35 retracts, the first ball 12 supported on member 35 is dropped into firing chamber 20 as member 51 moves to the up position supporting the next ball 12. With member 51 in the up position, additional balls cannot be introduced into chamber 20. Operation of feed mechanism 50 is repeated for each ball throwing operation. The feed tube 53 is slanted and formed from perforated steel rolled into a tube. This feed tube 53 construction facilitates operation and prevents undue pressure on pivotal member 51. Sleeve 35 has a plurality of circumferentially spaced openings 135 around one end. Openings 135 are provided to relieve any pressure present in firing chamber 20 as sleeve 35 moves to the open position. Pressure in chamber 20 can be the result of a jammed ball causing a trapped firing charge. The pressure would automatically be relieved as sleeve 35 opens, however the flow path would be over the sealing O-ring which might damage or unseat the O-ring. Controlled depressurization through openings 135 as sleeve 35 retracts prevents the sealing O-ring from being damaged or moved.

The material and thickness of resilient disc 14 effects the operating characteristics of ball throwing machine 10. A rubber material which has been found to be particularly suitable for the disclosed pitching machine is manufactured by B. F. Goodrich under the brand name of OR-50. This material meets ASTM Specification D735 and MIL Specification R 3065. The material has the following characteristics, Service: Oil resistant service sheet; Durometer: 50; Tensile Strength: 1000 psi; Working Temperatures: 212° F., 100° C; Weight: 7.9 No. yd. squared (based on $\frac{1}{8}$ inch thickness); Thickness: $\frac{1}{4}$inch; and Color: Black.

A typical disc 14 in the flat position has a diameter of 5 inches and a thickness of $\frac{1}{4}$ inch. Off center hole 16 has a diameter of 1 $\frac{1}{8}$ inches and is located 5/16 of an inch off center in disc 14. Disc 14 is clamped between flanges 118 and 120 which are connected to barrel 18 for movement therewith. Disc 14 develops a set during use by pulling away from flanges 118 and 120, but goes flat upon removal. Pressures in the range of 60 to 80 psi are required to force the ball through disc 14 after it has been broken in. The disc 14 can be broken in by firing a number of balls at a higher pressure, such as 120 psi.

The inner diameter of barrel 18 is 3$\frac{1}{4}$ inches which accommmodates a baseball having a diameter of approximately 2$\frac{7}{8}$ inches. The disc must contact the barrel during firing and the compressibility of the rubber against the barrel is a factor which determines firing pressure. Discs formed from various other resilient materials can be used as desired. For example, a disc formed from pure gum rubber would provide for less velocity. Changing other parameters in the disc 14 construction can change the operating characteristics. For example, a thicker disc provides for obtaining greater velocities. A disc 14 formed of a more resilient, but thicker, material permits greater velocity and more spin on the ball. Moving the hole 16 further off center increases the amount of spin imparted to the ball 12. Changing the diameter of hole 16 or varying the firing pressure also effect operation of ball throwing machine 10.

Figure 8:
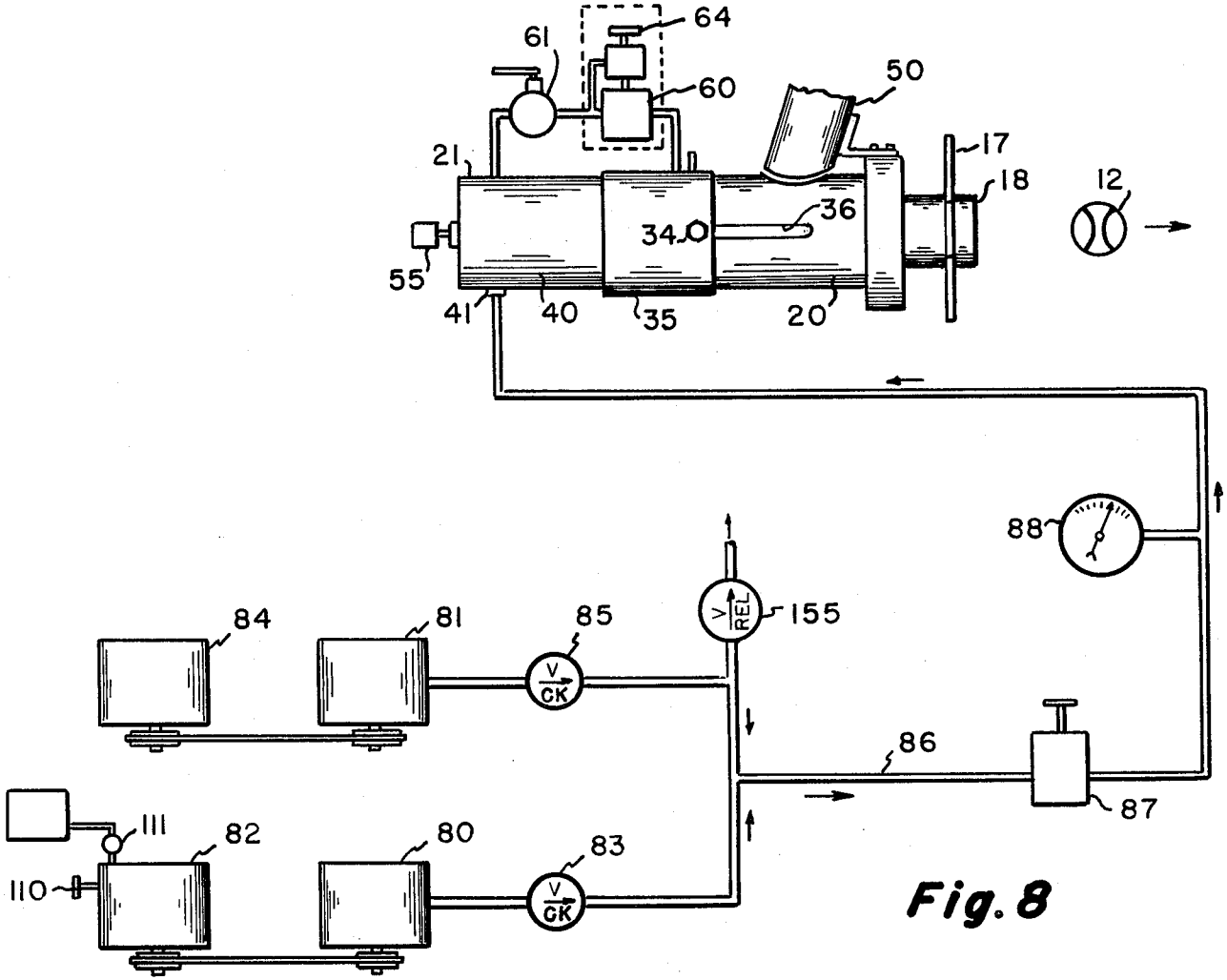
FIG. 8 is a schematic view of the pneumatic operating and control circuit for the disclosed ball throwing machine.

Referring now to FIG. 8 there is shown the schematic of the air operating and control circuit for the throwing machine 10. Air is supplied to the system from air compressor 80, or air compressor 81. Air compressor 80 is driven by a gasoline engine 82 and is provided with a check valve 83 for preventing air from flowing into the outlet of air compressor 80. Air compressor 81 is driven by an electric motor 84 and is provided with a check valve 85 for preventing air from flowing back into the outlet of air compressor 81. When an electric power source is readily available, electric driven air compressor 81 will normally be used. Where no electric outlets are available, the gasoline engine driven air compressor 80 will be utilized. Air compressors 80 and 81 feed a common supply line 86. A pressure relief valve 155 is connected to common supply line 86 to prevent an over pressure build up. A speed regulator valve 87 feeds regulated air to the inlet 41 of air reservoir 40. A speed indicator 88 is provided in the connection to the inlet of air reservoir 40. Speed indicator 88 is a pressure valve which can be calibrated to indicate the speed of the ball 12 as ejected from thrower 10, which is determined by the pressure within air reservoir 40. Speed regulator 87 is adjustable to control the velocity of the ball 12 thrown from machine 10. An interval timer 64, formed integral with firing valve 60, which is disposed between firing chamber 20 and manual valve 61, controls operation of ball thrower 10 when manual valve 61 is left in the open position. Interval timing valve 64 is constructed to pass an air charge at selected intervals to control opening of firing valve 60. With interval timer 64 controlling operation of throwing machine 10, balls 12 will be automatically thrown at determinable intervals. With interval timer 64 set for a very short time delay, operation of the ball thrower 10 can be controlled manually by opening and closing manual valve 61 as desired.

Figure 2:
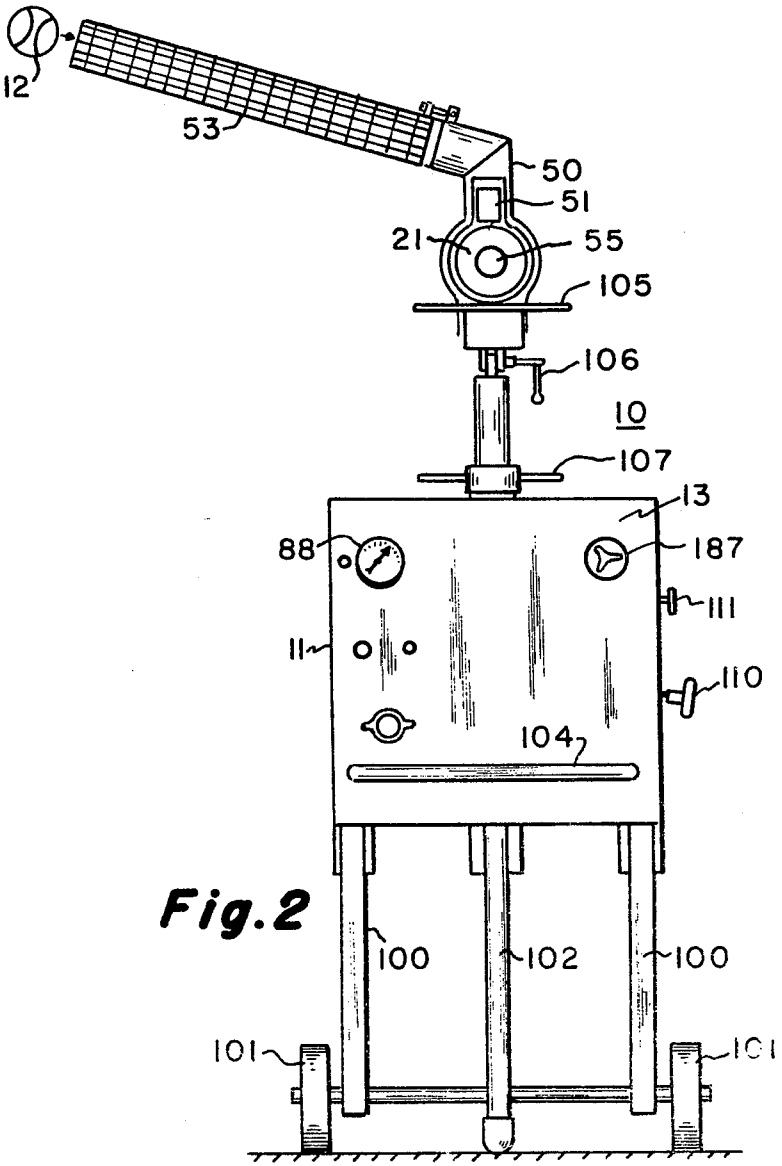
FIG. 2 is a front view of the ball throwing machine shown in FIG. 1.

Referring now to FIGS. 1 and 2, there is shown a throwing machine 10 utilizing the teaching of the present invention and mounted on a relatively portable frame assembly 11. Frame assembly 11 has wheels 101 mounted thereto and includes a movable leg 102. Wheels 101 are mounted on legs 100. Legs 100 and 102 can be folded up to permit the ball thrower 10 to be easily moved or stored. Handles 103 and 104 connected to frame 11 permit easy movement of the throwing machine 10. Control handles 105 are provided on tubular assembly 21. Handles 105 in conjunction with handtype connector 106 permit the angle of elevation of the barrel 18, firing chamber 20 and air receiver 40 to be easily varied. Control handle 107 permits the azimuthal direction of the ball trajectory to be varied. An engine pull starter handle 110 for internal combustion engine 82 is provided on the side of frame 11. A gasoline control valve 111 is provided for shutting off the gasoline supply during transportation. Control panel 13 is provided on frame 11 opposite the side from which the ball 12 is ejected. A velocity setting handle regulator 87 and velocity indicator 88 are provided to show the velocity of the ball to be ejected.

Figure 7:
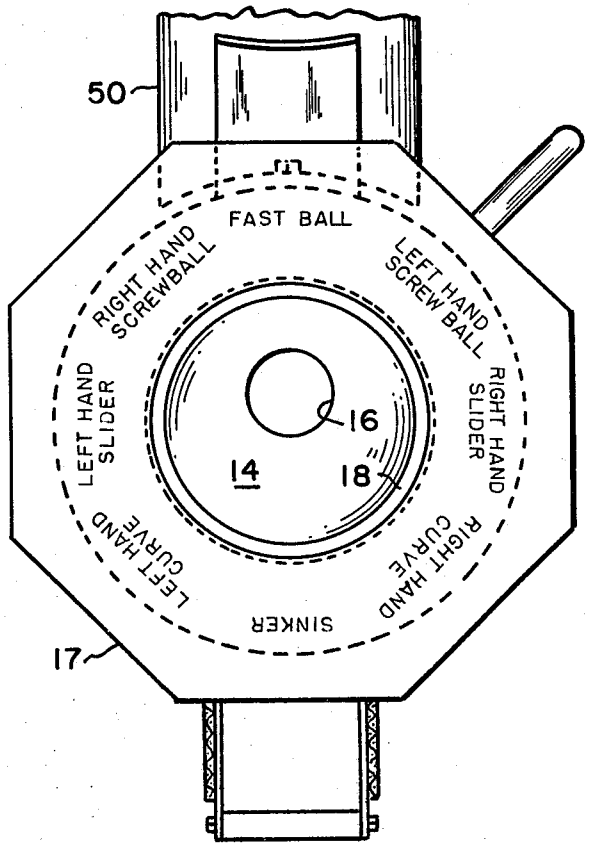
FIG. 7 is a view of the ball throwing machine as shown in FIG. 6 along the line VII—VII illustrating clearly the selector.
Figure 5:
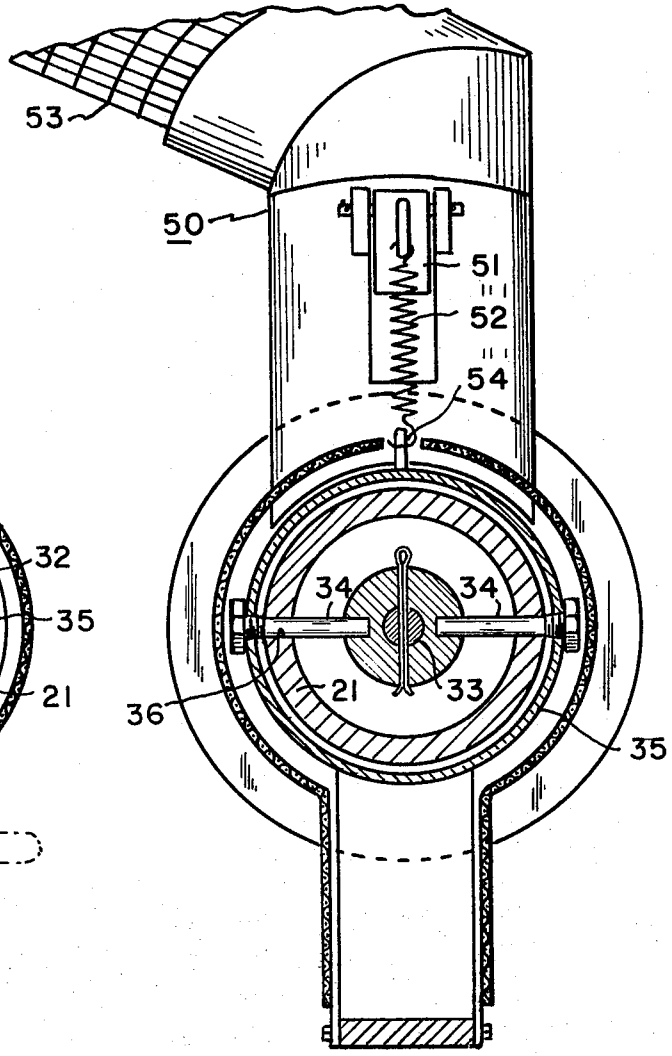
FIG. 5 is a view of the ball throwing machine shown in FIG. 3 along the line V—V.
Figure 4:
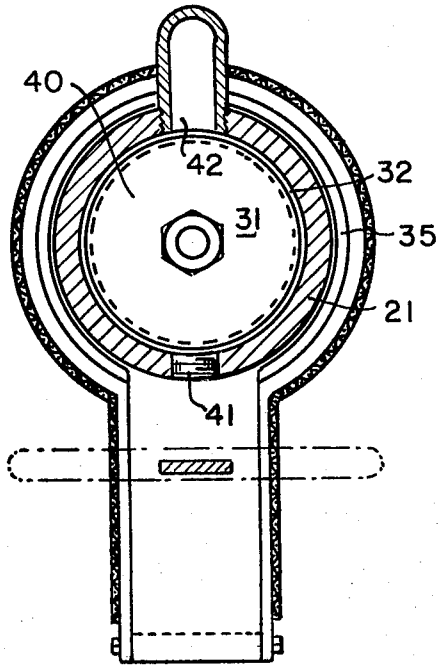
FIG. 4 is a view of the ball throwing machine shown in FIG. 3 along the line IV—IV.

Referring now to FIG. 7 there is shown a pitch selector 17 for selecting various types of baseball pitches. Pitch selector 17 is connected to flexible disc 14 for unitary movement. Balls 12 ejected from thrower 10 will curve in the direction which the opening 16 is positioned off center in disc 14. As pitch selector 17 is set in different positions the location of opening 16 is varied so the desired spin is imparted to balls 12 when thrown. The calibration on pitch selector 17 can be varied for different sports, as desired.

Thus it can be seen that a lightweight, portable throwing machine is provided which is adjustable for speed and curve direction. The disclosed throwing machine provides for highly accurate, repeatable operations. The disclosed machine is of a simple, rugged, relatively inexpensive construction.

What is claimed is:

1. A ball throwing machine comprising:

a ball;

a circular member formed of a resilient material having an off-center opening formed therethrough which opening is of a substantially smaller diameter than the ball to be thrown;

selector means for generating a selected spin on said ball; and, propulsion means for forcing a ball through the off-center opening of said circular member at a predetermined velocity and generating the selected spin on said ball as a function of the selector means.

2. A ball throwing machine as claimed in claim 1 comprising:

a barrel disposed in proximity to the off-center opening of said circular member through which the ejected ball travels after being forced through the off-center opening; and said circular member moved into contact with the inner diameter of said barrel as the ball is forced through the off-center opening.

3. A ball throwing machine as claimed in claim 1 comprising:

a firing chamber having said circular member disposed at one end thereof and being sealable;

mans for feeding the ball to be thrown into the firing chamber; and said propulsion means comprises a compressed air supply which can be rapidly fed into said firing chamber, when sealed, for forcing the ball out of said firing chamber through the off-center opening in said circular member.

4. A ball throwing machine as claimed in claim 3 having a firing means disposed between said compressed air supply and said firing chamber which comprises:

an air controlled firing valve which is movable between an open position and a closed position; and, an interval timer for operating said firing valve at predetermined intervals.

5. A ball throwing machine as claimed in claim 3 wherein:

said selector means connected to said circular member for providing circumferential positioning of the off-center hole formed through said circular member.

6. A ball throwing machine as claimed in claim 1 comprising:

automatic ball feed means for automatically feeding a new ball into position to be thrown after said propulsion means forces a ball through said flat circular member.

7. A ball throwing machine comprising:

a resilient disc having an off center circular opening formed therethrough which opening is substantially smaller than the ball to be thrown;

a tubular barrel positioned adjacent to said resilient disc with the opening in said resilient disc disposed in proximity to one end of said tubular barrel;

an elongated firing chamber generally aligned with said tubular barrel disposed in proximity to the opening through said resilient disc on the side opposite said tubular barrel;

positioning means for moving a ball to be thrown into engagement with a portion of said resilient disc surrounding the opening;

ejecting means for rapidly forcing the ball to be thrown through the opening in said resilient disc and through said tubular barrel; and said resilient disc formed so when the ball is forced through the off center opening the portion of said resilient disc surrounding the opening is forced into contact with the inner diameter of said tubular barrel.

8. A ball throwing machine as claimed in claim 7 wherein said ejecting means comprises:

sealing means for sealing said firing chamber;

a compressed air supply;

firing means disposed between said compressed air supply and said firing chamber for rapidly introducing compressed air into said firing chamber when activated; and including, selector means connected to said resilient disc for rotating said resilient disc to various positions.

9. A ball throwing machine as claimed in claim 8 wherein said compressed air supply comprises:

first compressor means which can be electrically driven for supplying compressed air;

second compressor means which can be driven by an internal combustion engine for supplying compressed air; and an air reservoir connected to said first compressor means and said second compressor means.

10. A ball throwing machine as claimed in claim 9 comprising:

regulator means connected to said air reservoir for regulating the pressure of the compressed air in said air reservoir.

11. A ball throwing machine as claimed in claim 7 comprising:

a compressed air reservoir disposed at the end of said firing chamber opposite said resilient disc;

said positioning means comprising a piston disposed between said compressed air reservoir and said firing chamber, a portion of which moves into said firing chamber positioning a ball which is located therein, into engagement with said resilient disc, when pressure in said compressed air reservoir exceeds a predetermined level.

12. A ball throwing machine as claimed in claim 11 comprising:

spring biasing means biasing said piston into said air reservoir; and firing means connected between said compressed air reservoir and said firing chamber for completing a connection between said compressed air reservoir and said firing chamber allowing for free communication between said compressed air reservoir and said firing chamber.

13. A ball throwing machine as claimed in claim 12 wherein said firing means is positionable in response to an air signal and comprises an interval timer operating said firing means at selected adjustable intervals.

14. A ball throwing machine as claimed in claim 7 comprising:

automatic ball feed means for automatically feeding a ball into said elongated firing chamber after said ejecting means forces a ball through said barrel.

15. A ball throwing machine comprising:

a resilient disc having an off center opening therethrough;

a tubular barrel positioned adjacent to said resilient disc with the opening in said resilient disc disposed in proximity to one end of said tubular barrel;

an elongated firing chamber generally aligned with said tubular barrel disposed in proximity to the opening through said resilient disc on the opposite said tubular barrel;

positioning means for moving a ball to be thrown into engagement with a portion of said resilient disc surrounding the opening;

ejecting means for rapidly forcing the ball to be thrown through the opening in said resilient disc and through said tubular barrel; and pitch selector means connected to said resilient disc for rotating said resilient disc to various positions.

16. A ball throwing machine as claimed in claim 15 comprising:

a plurality of different labels, spaced apart on said pitch selector means, each label indicative of the type of pitch to be thrown by the ball throwing machine when set at a preselected position.

17. A pneumatic throwing machine comprising:

an air compressor means for supplying compressed air;

an air reservoir connected to said air compressor means for storing compressed air at a predetermined pressure;

a tubular firing chamber having a closed end and an ejecting end through which the object to be thrown is expelled;

a resilient member having an off-center opening therethrough, substantially smaller in area than the object to be thrown, disposed at the ejecting end of said firing chamber;

feed means for feeding the object to be thrown into said tubular firing chamber;

sealing means for sealing the portion of said tubular firing chamber between the object to be thrown and the closed end; and firing means for connecting said air reservoir to the sealed portion of said firing chamber whereby the object to be thrown is forced out of the off-center firing chamber through the opening in said resilient member.

18. A pneumatic throwing machine as claimed in claim 17 comprising:

a tubular barrel longitudinally aligned with said tubular firing chamber disposed on the opposite side of and in proximity to said resilient member; and selecting means secured to said resilient member for adjustably positioning the off-center opening with respect to the longitudinal axis of said tubular firing chamber.

19. A pneumatic throwing machine as claimed in claim 18 wherein:

said air reservoir, said tubular firing chamber, and said barrel are aligned along a longitudinal axis; and adjusting means for adjusting the longitudinal axis along which said air reservoir, said tubular firing chamber, and said barrel are aligned.

20. A pneumatic throwing machine as claimed in claim 18 comprising:

interval timer means connected to said firing means for activating said firing means at selected intervals.

21. A pneumatic throwing machine as claimed in claim 17 wherein said air compressor means comprises:

a first air compressor which is electrically driven;

a second air compressor which is driven by an internal combustion engine; and further comprising, a housing having said first air compressor which is electrically driven and said second air compressor which is driven by an internal combustion engine disposed therein;

support means for supporting said air reservoir and said tubular firing chamber above said housing; and legs, pivotally connected to said housing, movable between a lowered position supporting said housing spaced apart from the ground and a raised position in proximity to the bottom of said housing.

22. A pneumatic throwing machine as claimed in claim 21 comprising:

a regulator connected to said air compressor means and said air reservoir for adjusting the pressure of the air fed to said air reservoir; and speed indicator means connected to said air reservoir for sensing the pressure therein and calibrated to indicate the speed of the object when expelled from the pneumatic throwing machine.

23. A pneumatic throwing machine as claimed in claim 21 comprising:

an air circuit connected to said firing means for controlling operation of said firing means.

24. A pneumatic throwing machine as claimed in claim 23 wherein said air circuit comprises:

a relief valve connected to communicate with the output of said air compressor;

a manual valve connected between said air reservoir and said firing means for controlling the air supply to said firing means; and, an interval timing valve connected between said manual valve and said firing means for controlling operation of said firing means when said manual valve is open.

25. A pneumatic throwing machine as claimed in claim 24 wherein:

said relief valve is connected to said air reservoir.

26. A pneumatic system for a ball throwing machine comprising:

air compressor means for compressing air;

an air reservoir connected to said air compressor means for storing compressed air;

regulator means disposed between said air compressor means and said air reservoir for setting the pressure of the air in said air reservoir;

a chamber within which balls to be thrown are positioned;

an air line connecting said air reservoir and said chamber; and an interval timer valve disposed in said air line between said air reservoir and said chamber having an open position, permitting free communication between said air reservoir and said chamber, and a closed position, preventing pneumatic communication between said air reservoir and said chamber, being switchable between the closed and open position at preselected adjustable intervals.

27. A pneumatic system as claimed in claim 26 comprising:

a manual air valve disposed in said air line in series with said interval timer valve.

28. A pneumatic system as claimed in claim 26 comprising:

a pressure indicator calibrated in velocity connected to said air reservoir for free pneumatic communication therewith.

29. A pneumatic system as claimed in claim 26 comprising:

a pressure relief valve connected to said air reservoir being operable manually to reduce the pressure in said air reservoir.

30. A pneumatic system as claimed in claim 29 wherein said air compressor means comprises:

a first air compressor connected to be driven by an electric motor;

a second air compressor connected to be driven by an internal combustion engine; and check valve means connected between said first air compressor and said second air compressor for isolating said first and second air compressors.

* * * * *

UNITED STATES PATENT AND TRADEMARK OFFICE

CERTIFICATE OF CORRECTION

PATENT NO. : 4,091,791

DATED : May 30, 1978

INVENTOR(S) : Joseph Tom Castelli and Joseph J. Forrester

It is certified that error appears in the above-identified patent and that said Letters Patent are hereby corrected as shown below:

Column 1, line 60, after "projects" --a-- should be inserted.

Claim 3, line 5, "mans" should read --means--.

Claim 17, line 21, "off-center" should be deleted; line 22, after "the" --off-center- should be inserted.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*